US010005645B2

(12) United States Patent
Delachatre et al.

(10) Patent No.: US 10,005,645 B2
(45) Date of Patent: Jun. 26, 2018

(54) TOE GUARD ASSEMBLY FOR AN ELEVATOR SYSTEM

(71) Applicant: OTIS ELEVATOR COMPANY, Farmington, CT (US)

(72) Inventors: Etienne Delachatre, Saint Benoit (FR); Juan Antonio Quiles Manzanas, Madrid (ES); Agustin Jimenez-Gonzalez, Madrid (ES); Antonio de Miguel Urquijo, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days. days.

(21) Appl. No.: 15/236,658

(22) Filed: Aug. 15, 2016

(65) Prior Publication Data

US 2016/0347579 A1 Dec. 1, 2016

Related U.S. Application Data

(62) Division of application No. 14/009,398, filed as application No. PCT/IB2011/001504 on Apr. 5, 2011, now Pat. No. 9,428,365.

(51) Int. Cl.
*B66B 13/28* (2006.01)

(52) U.S. Cl.
CPC ..... *B66B 13/285* (2013.01)

(58) Field of Classification Search
CPC ..... B66B 13/285; B66B 13/28
See application file for complete search history.

(56) References Cited

U.S. PATENT DOCUMENTS 4,457,403 A 7/1984 Ream
5,490,758 A 2/1996 Stone
(Continued)

FOREIGN PATENT DOCUMENTS

CH 431864 * 3/1967
CN 1982195 6/2001
(Continued)

OTHER PUBLICATIONS

English machine translation of EP 1118576.*
(Continued)

*Primary Examiner* — William E Dondero
*Assistant Examiner* — Diem M Tran
(74) *Attorney, Agent, or Firm* — Carlson, Gaskey & Olds

(57) ABSTRACT

An exemplary elevator assembly includes an elevator car having a frame member. At least one toe guard panel is moveable between a first position and a second position. In the first position the toe guard panel is situated to provide a vertical surface beneath the elevator car and the toe guard panel has an end spaced a first distance from the elevator car. In the second position the toe guard panel is situated with a second, shorter distance between the end and the elevator car. A moving mechanism coupled with the toe guard panel selectively moves the toe guard panel from the first position into the second position. An instigator member situated in a selected vertical position interacts with the moving mechanism to begin movement of the toe guard panel from the first position when the frame member of the elevator car is approximately at the selected vertical position.

20 Claims, 6 Drawing Sheets

(56) References Cited

U.S. PATENT DOCUMENTS

| | | | | |
|---|---|---|---|---|
| 6,095,288 | A | 8/2000 | Rivera et al. | |
| 7,779,967 | B2 | 8/2010 | Kocher et al. | |
| 8,356,699 | B2 | 1/2013 | Rasanen et al. | |
| 2007/0181377 | A1 | 8/2007 | Ketonen et al. | |
| 2008/0230327 | A1 | 9/2008 | Cabanas Falcon et al. | |
| 2009/0277725 | A1 | 11/2009 | Rasanen et al. | |
| 2009/0301821 | A1 | 12/2009 | Fujiki et al. | |
| 2010/0155184 | A1 | 6/2010 | Sirigu et al. | |
| 2014/0008158 | A1 | 1/2014 | Fauconnet et al. | |
| 2016/0122159 | A1* | 5/2016 | Delachatre | B66B 13/285 187/400 |

FOREIGN PATENT DOCUMENTS

| | | | | |
|---|---|---|---|---|
| DE | 10065101 | A1 | 7/2002 | |
| DE | 10115990 | C1 | 10/2002 | |
| DE | 10357035 | A1 | 6/2005 | |
| DE | 202011051638 | U1 | 1/2012 | |
| EP | 1118576 | A2 | 7/2001 | |
| EP | 1524234 | A1 | 4/2005 | |
| EP | 1772414 | A1 | 4/2007 | |
| WO | WO-02060802 | A2 * | 8/2002 | B66B 13/285 |
| WO | 2008074911 | A1 | 6/2008 | |
| WO | 2013054321 | A1 | 4/2013 | |

OTHER PUBLICATIONS

English machine translation of DE 10 065 101.*

International Search Report and Written Opinion of the International Searching Authority for International application No. PCT/IB2011/001504 dated Jan. 5, 2012.

Extended European Search Report for Application No. EP 11 86 3053 dated Jul. 28, 2014.

State Intellectual Property Office of People's Republic China, First Search, Application No. 201180069739.2 dated Dec. 19, 2014.

* cited by examiner

TOE GUARD ASSEMBLY FOR AN ELEVATOR SYSTEM

CROSS-REFERENCE TO RELATED APPLICATIONS

This application is a divisional of U.S. patent application Ser. No. 14/009,398 filed Oct. 2, 2013, which is the national stage application of PCT/IB2011/001504 filed Apr. 5, 2011.

BACKGROUND

Elevator cars typically include a toe guard situated beneath the elevator car. The toe guard is typically rigid and up to two meters in length. A significant amount of clearance beneath the elevator car is therefore required to avoid bumping the toe guard against the bottom of the shaft when the elevator car is situated at a lowest landing.

Elevator systems have included a pit at the bottom of the hoistway, in part, to provide sufficient clearance between the bottom of the elevator car and the bottom of the hoistway. Typical pit configurations provide a sufficient clearance for typical toe guards. More recently, however, elevator pits have been eliminated or reduced in size. Conventional toe guards do not allow for elevator cars in such systems to travel as low as necessary.

One suggestion for addressing such a situation is shown in U.S. Pat. No. 6,095,288. That document includes a toe guard panel that is moveable from a position where the toe guard extends vertically downward from the elevator car into a position where the toe guard is tucked beneath the elevator car in a nearly horizontal orientation.

SUMMARY

An exemplary elevator assembly includes a hoistway having a bottom surface and an elevator car, which is configured to move in the hoistway and which has a frame member. At least one toe guard panel is moveable between a first position and a second position. In the first position the toe guard panel is situated to provide a vertical surface beneath the elevator car and the toe guard panel has an end spaced a first distance from the elevator car. In the second position the toe guard panel is situated with a second, shorter distance between the end and the elevator car. A moving mechanism coupled with the toe guard panel selectively moves the toe guard panel from the first position into the second position. An instigator member, which is situated in a selected vertical position above the hoistway bottom, interacts with the moving mechanism to begin movement of the toe guard panel from the first position when the frame member of the elevator car is approximately at the selected vertical position.

In one example embodiment that includes the elements of any of the foregoing elevator assembly embodiments, the moving mechanism may comprise a lever having a first end connected to the toe guard panel and a follower member near a second, opposite end of the lever. The instigator may comprise a cam that guides the follower to cause the lever to move in a direction to urge the toe guard panel out of the first position. The cam may contact the follower at least when the frame member of the elevator car is at approximately the selected vertical position.

In another example embodiment that includes the elements of any of the foregoing elevator assembly embodiments, the follower may comprise a roller and the cam may comprise a surface at an oblique angle relative to a direction of movement of the elevator car.

In another example embodiment that includes the elements of any of the foregoing elevator assembly embodiments, the follower may have a first portion that contacts the cam and a second portion that is received in a groove on the elevator car frame. The groove may establish a path of movement for the follower corresponding to movement of the toe guard panel between the first and second positions.

In another example embodiment that includes the elements of any of the foregoing elevator assembly embodiments, one end of the groove may include a detent that the second portion of the follower is received against for preventing movement of the lever and for maintaining the toe guard panel in the first position. The instigator may cause the follower to be separated from the detent as the elevator car frame member descends to approximately the selected vertical position.

In another example embodiment that includes the elements of any of the foregoing elevator assembly embodiments, the cam may comprise a surface that the follower follows as the elevator car frame member moves downward from the selected vertical position.

In another example embodiment that includes the elements of any of the foregoing elevator assembly embodiments, the moving mechanism may comprise a first roller and the instigator may comprise a first cam at the selected vertical position. The first roller may contact the first cam as the frame member of the elevator car approaches the selected vertical position.

In another example embodiment that includes the elements of any of the foregoing elevator assembly embodiments, the first roller may be near one end of the toe guard panel and the moving mechanism may comprise a second roller closer to another end of the toe guard panel. A second cam may interact with the second roller to urge the toe guard panel further toward the second position.

In another example embodiment that includes the elements of any of the foregoing elevator assembly embodiments, the second cam may be positioned vertically beneath the first cam and the second cam may be near a lowest possible position of the elevator car frame member.

In another example embodiment that includes the elements of any of the foregoing elevator assembly embodiments, the assembly may also include a third roller and a third cam. The second cam may have a surface that urges the second roller in a first direction as the elevator car frame member descends beneath the selected vertical position. The third cam may have a surface that urges the third roller in a second direction that is generally opposite to the first direction.

In another example embodiment that includes the elements of any of the foregoing elevator assembly embodiments, the toe guard panel may comprise at least two panels that are foldable into the second position. The second roller and the second cam may urge one of the panels to move relative to another of the panels for moving into the second position.

In another example embodiment that includes the elements of any of the foregoing elevator assembly embodiments, a locking member may maintain the toe guard panel in the first position. The first cam may cause movement of the first roller to unlock the locking member to allow the toe guard panel to begin to move from the first position toward the second position.

In another example embodiment that includes the elements of any of the foregoing elevator assembly embodiments, the locking member may comprise a latch. Movement of the first roller along the first cam may cause rotation of the latch.

In another example embodiment that includes the elements of any of the foregoing elevator assembly embodiments, a bracket may be configured to position the instigator in the selected vertical position and may be configured to be connected with a guide rail for establishing a desired horizontal position of the instigator member relative to a path of movement of the elevator car.

The various features and advantages of disclosed example embodiments will become apparent to those skilled in the art from the following detailed description. The drawings that accompany the detailed description can be briefly described as follows.

DETAILED DESCRIPTION

Figure 1:
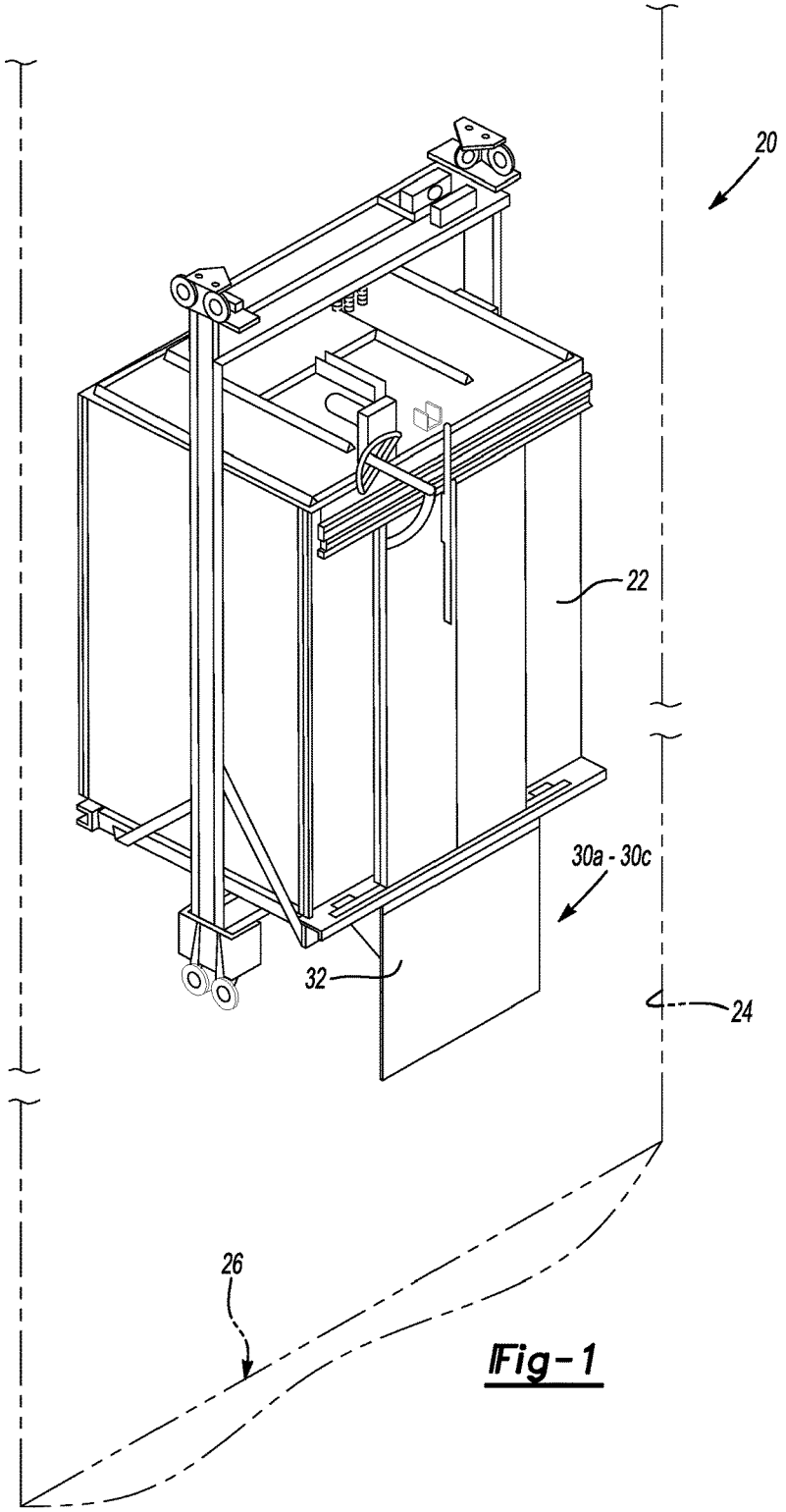
FIG. 1 schematically illustrates selected portions of an example elevator system including a toe guard assembly designed according to various embodiments of this invention.

FIG. 1 schematically shows selected portions of an elevator system 20. Only selected portions are illustrated. Those skilled in the art will realize that many other components are included in an elevator system. Such components are omitted from the illustration and this discussion for the sake of brevity and because those skilled in the art are already aware of such components.

An elevator car 22 is moveable within a hoistway 24. A surface 26 near the bottom of the hoistway 24 may be the floor of the pit or a bottom hoistway surface in examples that do not include a pit at the bottom of the hoistway 24.

A toe guard assembly 30A, 30B, 30C is provided on the elevator car 22 to cover a space between a bottom of the elevator car 22 and a nearby landing in the unlikely event that a hoistway door (not illustrated) is open and the car 22 is not aligned with the landing. The presence of the toe guard assembly 30A, 30B, 30C has an impact on how low the elevator car 22 can descend. Each example toe guard assembly 30A, 30B, 30C is moveable from the first position shown in FIG. 1 into a second position (shown in FIGS. 4, 7 and 11) that allows the elevator car 22 to descend closer to the surface 26 than it otherwise would be able to if the toe guard assembly 30A, 30B, 30C remained in the first position shown in FIG. 1.

Figure 2:
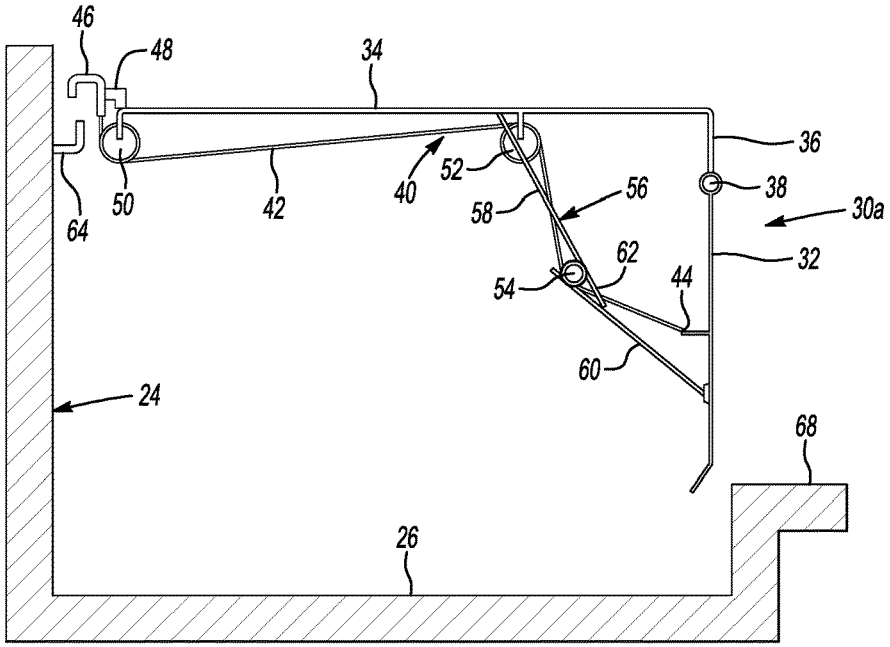
FIG. 2 schematically illustrates an example toe guard assembly with a toe guard panel in a first position.

FIG. 2 illustrates one example toe guard assembly 30A. This example includes a toe guard panel 32 shown in a first position in FIG. 2. In this example, the first position includes the toe guard panel 32 being in a vertical position and extending downward beneath the elevator car. In this example, an elevator car frame member 34 corresponds to a plank or floor of the elevator car. The toe guard panel 32 is oriented perpendicular to the frame member 34 in the first position shown in FIG. 2.

The example of FIG. 2 includes a stationary toe guard portion 36, which remains in a fixed position relative to the frame member 34 and which may, for example, be part of a conventional door sill. The toe guard panel 32 is moveable between the first position shown in FIG. 2 and a second position shown in FIG. 4.

In this example, the toe guard panel 32 is supported by a pivotal mounting 38 so that it is moveable relative to the stationary toe guard portion 36. The example of FIG. 2 includes a moving mechanism 40 for moving the toe guard panel 32 from the first position to the second position.

The moving mechanism 40 includes a cable 42 connected with the toe guard panel 32 near a first end 44 of the cable 42. A hook 46 is connected with the cable 42 near an opposite end of the cable 42. A hook positioner 48 holds the hook 46 in a desired position relative to the elevator car frame member 34 when the panel 32 is in the first position.

The cable 42 extending between the connection with the toe guard panel 32 at 44 and the hook 46 follows a path that includes at least partially wrapping around wheels 50 and 52 that are supported on the elevator car. The cable 42 also is received against a pivot 54, which is part of a hinge 56 associated with the toe guard panel 32. In this example, the hinge 56 has a first arm 58 extending between the elevator car frame member 34 and the pivot 54. A second arm 60 extends between the pivot 54 and the toe guard panel 32. The hinge 56 facilitates movement of the toe guard panel 32 about the pivotal mounting 38.

In this example, the hinge 56 includes a limit feature 62 that limits an amount of movement of the toe guard panel 32 to ensure a desired vertical orientation of the toe guard panel 32. In this example, the limit feature 62 is a portion of the arm 58 received against the arm 60 when the toe guard panel 32 is in the first position. The presence of the cable 42 received against the pivot 54 and the limit feature 62 cooperates to maintain the toe guard panel 32 in the first position in a suitably stable manner to provide a desired toe guard function during elevator system operation.

An instigator member 64 is situated at a selected vertical position along the hoistway 24. The instigator member 64 causes the moving mechanism 40 to move the toe guard panel 32 from the first position (shown in FIG. 2) toward the second position (shown in FIG. 4). In this example, the instigator member 64 comprises a catch that engages the hook 46 for pulling on the cable 42 as the car frame member 34 descends below the vertical position of the instigator member 64. As can be appreciated from FIG. 3, the frame member 34 has descended below the vertical position of the instigator member 64. This causes relative, upward movement between the hook 46 and the hook positioner 48 because the hook 46 remains at the vertical position of the instigator member 64. Because the cable 42 has a fixed length, the toe guard panel 32 is urged out of the first position and pivots about the pivot mount 38 toward the second position as the frame member 34 continues to descend.

Figure 3:
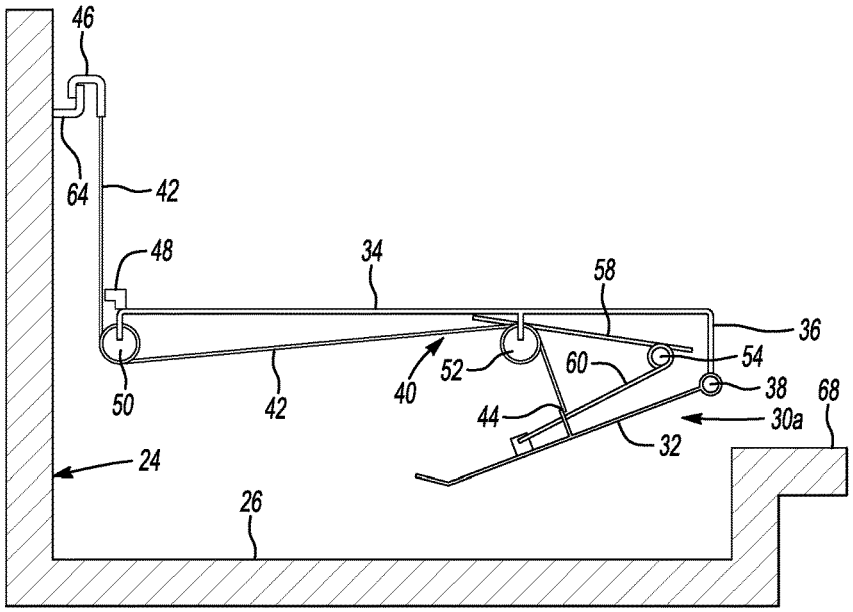
FIG. 3 schematically illustrates the example of FIG. 2 in another orientation.

In addition to the cable pulling on the toe guard panel 32, the cable 42 in this example urges the pivot 54 toward the toe guard panel at the beginning of the movement of the toe guard panel 32 out of the first position. FIG. 3 shows an intermediate point where the toe guard panel 32 is between the first position and the example second position of FIG. 4.

Figure 4:
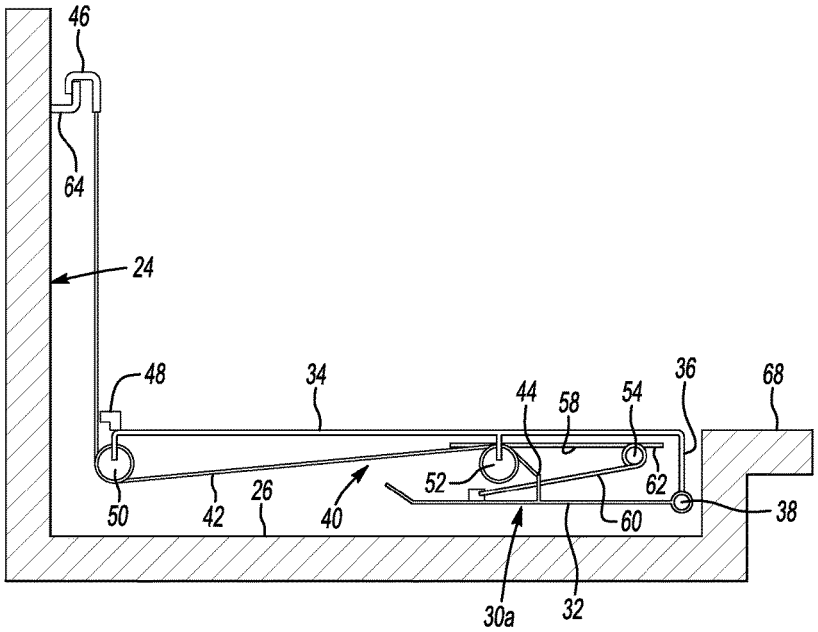
FIG. 4 schematically illustrates the example of FIG. 2 with the toe guard panel in a second position.

FIG. 4 shows the frame member 34 in a lowest possible position relative to the lower surface 26 of the pit at the bottom of the hoistway 24. At this point, the cable 42 has pulled the toe guard panel 32 all the way into the example second position, which includes the toe guard panel 32 being generally parallel to a floor of the elevator car. In this example, the lowest position of the frame member 34 corresponds to the floor of the elevator car being aligned with a surface of the lowest landing 68 that is serviced by the elevator car along the hoistway 24. As can be appreciated from comparing FIGS. 2 and 4, if the toe guard panel 32 remained in the first position, it would be impossible for the frame member 34 to descend low enough for the floor of the elevator car to arrive at the lowest landing 68. This is because of the limited depth of the pit at the bottom of the hoistway 24. With the toe guard panel 32 moved into the second position, however, the desired elevator service to the lowest landing 68 becomes possible.

As the frame member 34 ascends through the hoistway 24 and approaches the instigator member 64, the hook positioner 48 removes the hook 46 from the catch so that the components of the moving mechanism 40 are once again in the configuration shown schematically in FIG. 2. The weight of the toe guard panel 32 tends to urge it into the first position as the elevator car ascends from the lowest position shown in FIG. 4. In some examples, the hinge 56 is spring loaded so that it is biased into the position shown in FIG. 2, which facilitates returning the toe guard panel 32 to the first position from the second position.

Figure 5:
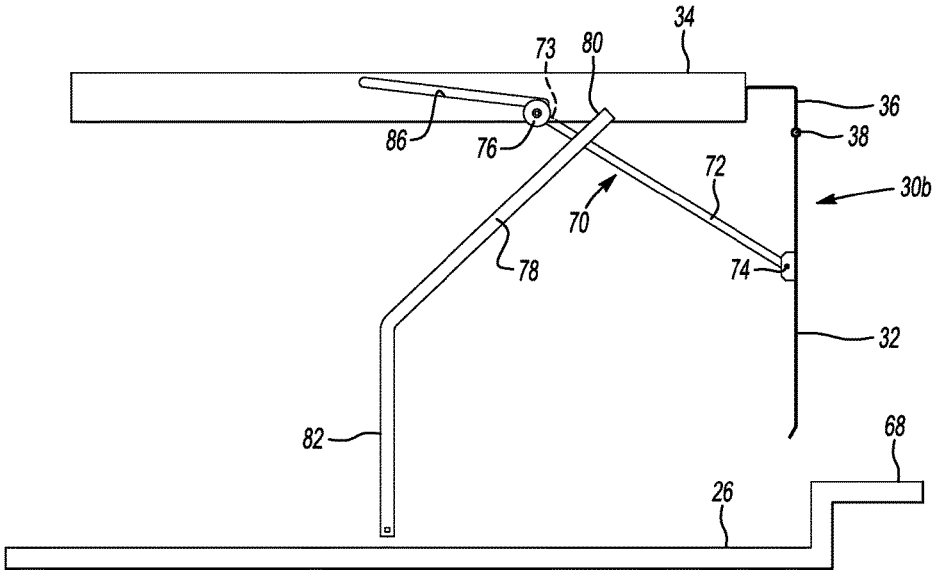
FIG. 5 schematically illustrates another example toe guard assembly with a toe guard panel in a first position.
Figure 6:
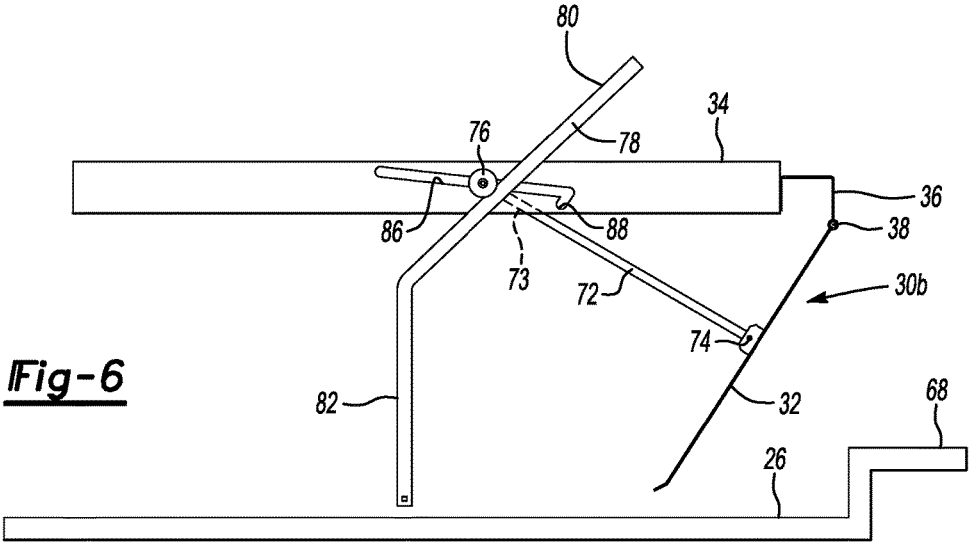
FIG. 6 schematically illustrates the example of FIG. 5 in another orientation.
Figure 7:
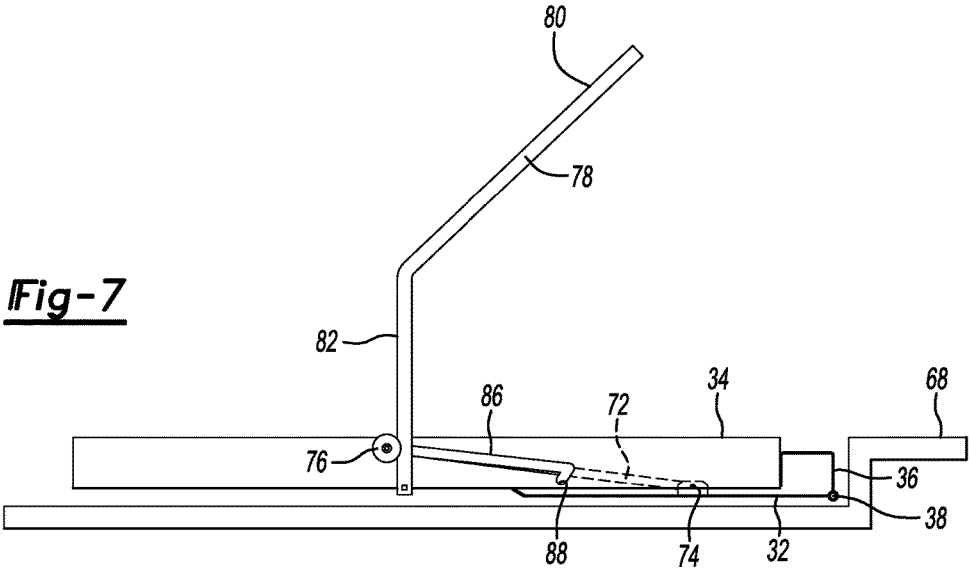
FIG. 7 schematically illustrates the example of FIG. 5 with a toe guard panel in a second position FIG. 8 schematically illustrates another example toe guard assembly with a toe guard panel in a first position.

FIGS. 5-7 schematically illustrate another example toe guard assembly 30B. In this example, the toe guard panel 32 includes a single moveable panel that pivots about a pivot mount 38 between a first position shown in FIG. 5 and a second position shown in FIG. 7. A moving mechanism 70 in this example includes a lever 72 that is connected with the toe guard panel 32 at 74 near a first end of the lever 72. In this example, the connection at 74 allows for pivotal movement between the lever 72 and the toe guard panel 32.

The moving mechanism 70 includes a follower 76 near an opposite end 73 of the lever 72. The follower 76 interacts with an instigator member 78 for moving the toe guard panel 32 out of the first position (shown in FIG. 5) as the elevator car descends toward the surface 26. The instigator member 78 includes a cam surface 80 at a selected vertical position where the follower 76, which comprises a roller in this example, contacts the cam surface 80 to begin moving the toe guard panel 32 out of the first position.

As the elevator car descends and the car frame member 34 approaches approximately the selected vertical position of the cam surface 80 on the instigator member 78, the follower 76 contacts the cam surface and follows along it as the elevator car continues to descend. This can be appreciated by comparing FIGS. 5, 6 and 7, each of which shows the elevator car descending progressively lower. The instigator member 78 in this example includes the cam surface 80 oriented at an oblique angle relative to the direction of travel of the elevator car. Another surface 82 in this example is vertically oriented because of the length of the lever 72 in this example. In this example, the selected vertical position may be at or near a vertically highest portion of the cam surface 80. The follower 76 follows along the instigator member 78 from the point of contacting it near the selected vertical position to a lowest point shown in FIG. 7 when the toe guard panel 32 reaches the fullest extent of the second position.

In this example, the toe guard panel 32 is oriented vertically in the first position shown in FIG. 5 in which the toe guard panel 32 is generally perpendicular to a floor of the elevator car. In the second position shown in FIG. 7, the toe guard panel 32 is horizontal and generally parallel to a floor of the elevator car. In the illustrated example, the frame member 34 has one side at approximately the horizontal position of the elevator car floor.

One feature of this example is that the follower 76 includes a roller portion that rides along the surfaces 80 and 82 of the instigator member 78. Another follower portion, which is received within a groove 86 (which in this example is associated with the frame member 34), connects the roller portion to the opposite end 73 of the lever 72. With this construction, the lever 72 and the roller portion of the follower 76 are provided on opposite sides of the car frame 34 whereas the connecting potion of the follower 76 extends through the car frame 32. The groove 86 guides movement of the follower relative to the frame member 34 as the follower 76 moves along the surfaces 80 and 82.

The example groove 86 includes a detent 88 (FIGS. 6 and 7) against which the follower 76 is received when the toe guard panel 32 is in the first position shown in FIG. 5. In this example, the detent 88 includes a recess near one end of the groove 86 into which the connecting portion of the follower 76 is received whenever the follower 76 is not interacting with the instigator member 78. In this example, the groove 86 is oriented at an angle so that as gravity pulls down on the toe guard panel 32, the lever 72, and the follower 76, the connecting portion of the follower 76 will automatically be received into the recess against the detent 88. When in the first position shown in FIG. 5, the engagement of the connecting portion of the follower 76 against the detent 88 biases the toe guard panel 32 from moving out of the first position. In this example, as the elevator car descends and the frame member 34 reaches the selected vertical height of the instigator member 78, the connecting portion of the follower 76 is urged upward out of the recess away from the detent 88 and then along a remainder of the groove 86 as the elevator car continues to descend and the rolling portion of the follower 76 rolls along the surfaces 80 and 82 of the instigator 78.

As can be appreciated from the drawings, if the toe guard panel 32 remained in the first position, the car frame member 34 would be unable to descend low enough to be at approximately the level of the surface of the lowest landing 68 because of the relatively shallow depth of the pit at the bottom of the hoistway 24. In other words, the distance from the lower surface 26 of the hoistway to the surface of the lowest landing 68 is shorter than the vertical length of the toe guard panel 32 in the first position. The moving mechanism 70 and the moveable toe guard panel 32 allow for the elevator car 22 to descend low enough to enable the lowest landing 68 to be serviced by the car 22, for example.

FIGS. 8-11 show another example toe guard assembly 30C. In this example, the toe guard panel 32C comprises a plurality of panel portions. A first panel portion 90 has a hinged connection 92 with a second panel portion 94. A plurality of stiffeners 96 are secured to the second panel portion 94 and they remain fixed relative to each other. The first panel portion 90 is moveable relative to the second panel portion 94.

Figure 8:
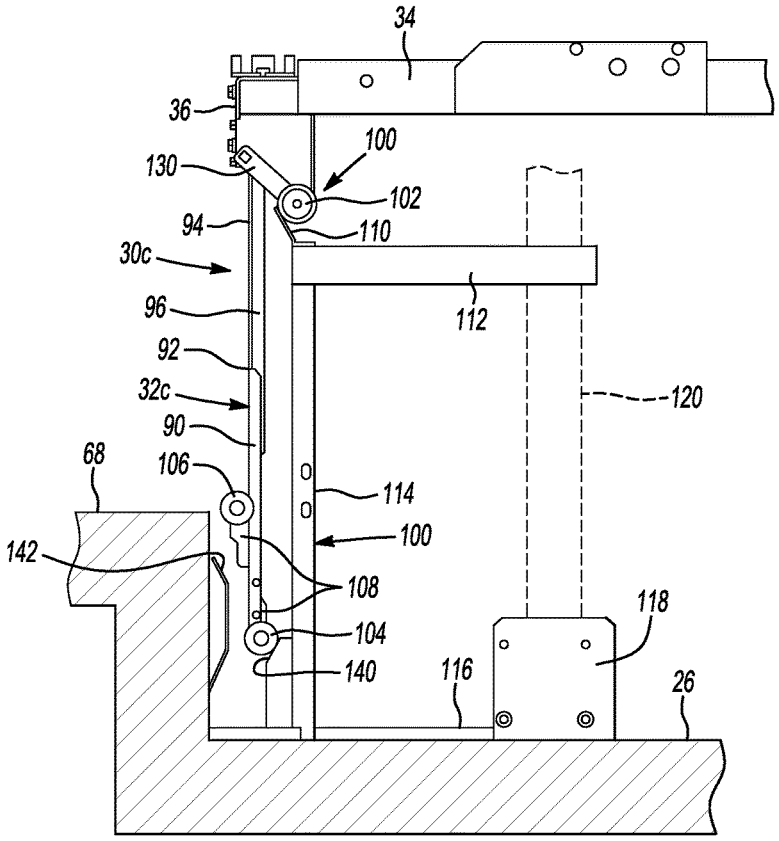

FIG. 8 shows the toe guard panel 32C in the first position in which the toe guard panel 32 is in a vertical position and generally perpendicular to the example frame member 34. The toe guard panel 32 is moveable from the first position shown in FIG. 8 to the second position shown in FIG. 11 when needed to allow the elevator car 22 to descend to the lowest landing 68 such that the distance between the frame member 34 and the lower surface 26 is smaller than the vertical height of the toe guard panel 32C when it is in the first position.

Figure 11:
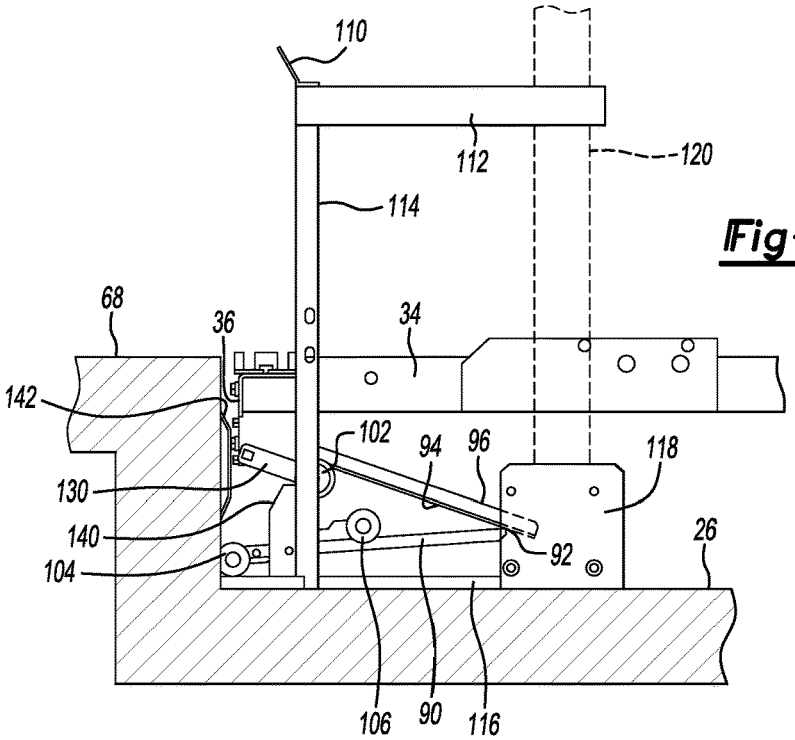
FIG. 11 schematically illustrates the example of FIG. 8 with the toe guard panel in a second position.

A moving mechanism 100 facilitates moving the toe guard panel 32C between the first position (shown in FIG. 8) and the second position (shown in FIG. 11). In this example, the moving mechanism 100 includes a first roller 102, a second roller 104 and a third roller 106. The second roller 104 and the third roller 106 are supported by brackets 108 that are secured to the first panel portion 90.

As the frame member 34 descends to approximately the vertical position of an instigator member 110, the moving mechanism 100 begins to move the toe guard panel 32 from the first position. In this example, the instigator member 110 includes a cam surface that the roller 102 engages as the frame member 34 descends to approximately the position of the instigator member 110.

In this example, the instigator member 110 is supported by a bracket member 112 that is associated with brackets 114, 116 and 118. The bracket members 112 and 118 can be secured to a guide rail 120 to maintain a desired position of the instigator member 110 relative to the lower surface 26 and the surface of the lowest landing 68, for example.

Figure 9:
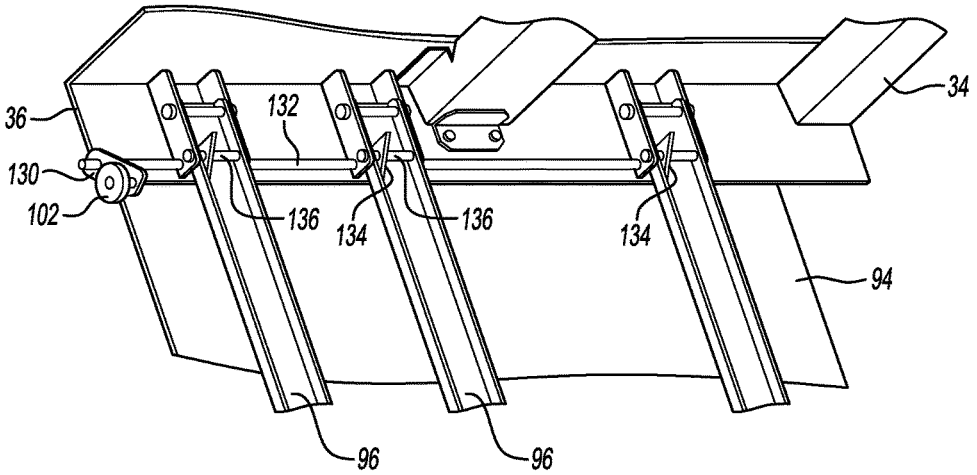
FIG. 9 schematically illustrates selected features of the example of FIG. 8.

As can best be appreciated from FIG. 9, the roller 102 is supported on a lever bracket 130 near an edge of the stationary toe guard portion 36. The lever bracket 130 is associated with a rod 132 such that when the roller 102 engages the cam surface on the instigator member 110, the lever bracket 130 pivots and causes rotation of the rod 132. A plurality of latch locking members 134 are coupled with the rod 132. As the roller 102 engages the cam surface of the instigator member 110, the locking members 134 are rotated (generally counterclockwise according to FIG. 9) so that the locking members 134 are released from posts 136 that are connected with the stiffeners 96. The locking members 134 maintain the toe guard panel 32 in the first position whenever they engage the posts 136. The instigator member 110 and the roller 102 cooperate to release the locking members 134 to allow the toe guard panel 32 to begin movement out of the first position.

As can be appreciated from FIG. 8, the second roller 104 engages a cam surface 140. In this example, the cam surface 140 urges the second roller 104 toward the landing surface side of the hoistway (to the left according to the drawing). This movement of the roller 104 tends to urge the lower end of the first panel portion 90 in one direction and causes the upper end of the first panel portion 90 near the hinged connection 92 to move in an opposite direction. In the illustrated example, the lower end of the first panel portion 90 is urged to the left while the upper end of the first panel portion 90 is urged to the right (according to the drawing). This movement urges the toe guard panel 32 toward the second position.

As the elevator car and the frame member 34 continue to descend, the second roller 104 eventually engages the surface 26 at the bottom of the hoistway. As can be appreciated from FIG. 10, for example, the third roller 106 engages another cam surface 142. The position and orientation of the cam surface 142 causes the roller 106 to move in a direction that is opposite the direction that the cam surface 140 causes the second roller 104 to move, which occurs prior to the third roller 106 engaging the cam surface 142 in this example. The roller 106 movement along the cam surface 142 continues to urge the toe guard panel 32 toward the second position by facilitating further folding of the panel portions 90 and 94 relative to each other.

Figure 10:
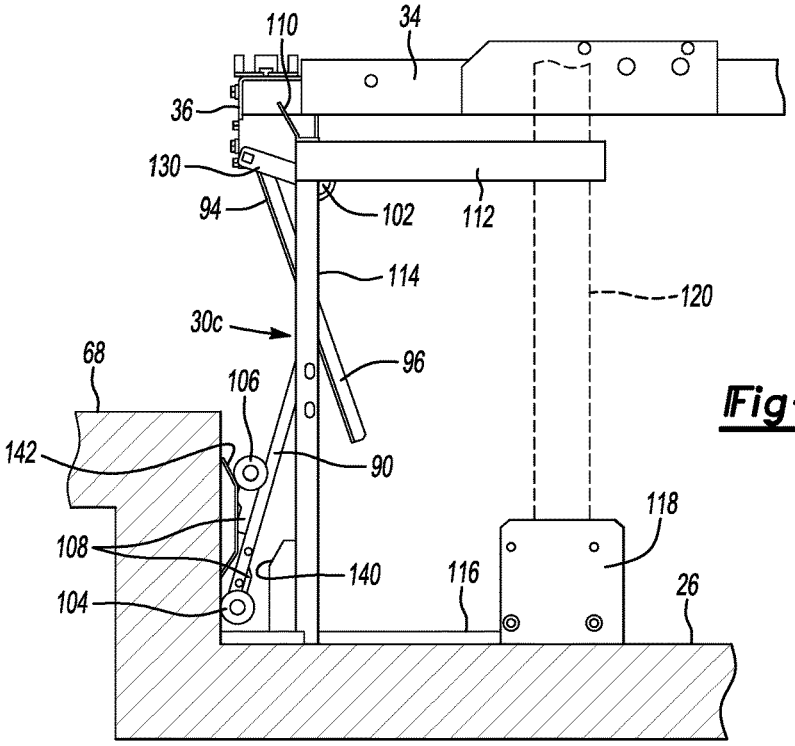
FIG. 10 schematically illustrates the example of FIG. 8 in another orientation.

As the car frame member continues to descend from the position shown in FIG. 10 to the position shown in FIG. 11, the toe guard panel 32 continues to fold until the second position shown in FIG. 11 is reached. In this example, the second position of the toe guard panel 32 corresponds to the frame member 34 being at a vertical position that aligns a floor of the elevator car with the surface of the lowest landing 68.

As the frame member 34 subsequently ascends to a higher vertical position, the weight of the toe guard panel assembly components tends to urge the toe guard panel 32 back into the first position.

Several example toe guard assemblies are shown that include a moving mechanism for facilitating movement of the toe guard panel from a first position toward a second position to accommodate hoistway configurations that have a relatively shallow pit depth or no pit. Although various features are shown with each of the embodiments, they are not necessarily limited to only the embodiments that are shown. One or more features of one of the example embodiments may be incorporated with or combined with one or more features of another one of the embodiments to meet the needs of a particular situation. Those skilled in the art who have the benefit of this description will realize which of the disclosed features will best suit their particular needs.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator assembly, comprising:

a hoistway having a bottom surface;

an elevator car configured to move in the hoistway having a frame member;

at least one toe guard panel that is moveable between a first position and a second position, in the first position the toe guard panel is situated to provide a vertical surface beneath the elevator car and the toe guard panel has an end at a bottom of the toe guard panel, the end being spaced a first distance from the elevator car, in the second position the toe guard panel is situated with a second, shorter distance between the end and the elevator car;

a moving mechanism coupled with the toe guard panel for selectively moving the toe guard panel from the first position into the second position;

an instigator member situated in a selected vertical position above the hoistway bottom surface and above the end of the toe guard panel to interact with the moving mechanism to begin movement of the toe guard panel from the first position when the frame member of the elevator car is approximately at the selected vertical position;

wherein the moving mechanism comprises a first roller and the instigator comprises a first cam at the selected vertical position, the first roller contacting the first cam as the frame member of the elevator car approaches the selected vertical position, the selected vertical position being closer to the frame member than the end of the toe guard panel when the first roller contacts the first cam; and wherein the first roller is near one end of the toe guard panel and the moving mechanism comprises a second roller closer to another end of the toe guard panel, the assembly comprising a second cam at least partially above the bottom surface, the second cam interacts with the second roller to urge the toe guard panel toward the second position.

2. The system of claim 1, wherein the second cam is positioned vertically beneath the first cam and the second cam is near a lowest possible position of the elevator car frame member.

3. The system of claim 1, comprising a third roller and a third cam, the second cam having a surface that urges the second roller in a first direction as the elevator car frame member descends beneath the selected vertical position, the third cam having a surface that urges the third roller in a second direction that is generally opposite to the first direction.

4. The system of claim 1, wherein the toe guard panel comprises at least two panels that are foldable into the second position and wherein the second roller and the second cam urge one of the panels to move relative to another of the panels for moving into the second position.

5. The system of claim 1, comprising a locking member that maintains the toe guard panel in the first position and wherein the first cam causes movement of the first roller to unlock the locking member to allow the toe guard panel to begin to move from the first position toward the second position.

6. The system of claim 5, wherein the locking member comprises a latch and movement of the first roller along the first cam causes rotation of the latch.

7. An elevator assembly, comprising:

a hoistway having a bottom surface;

an elevator car configured to move in the hoistway having a frame member;

at least one toe guard panel that is moveable between a first position and a second position, in the first position the toe guard panel is situated to provide a vertical surface beneath the elevator car and the toe guard panel has an end at a bottom of the toe guard panel, the end being spaced a first distance from the elevator car, in the second position the toe guard panel is situated with a second, shorter distance between the end and the elevator car;

a moving mechanism coupled with the toe guard panel for selectively moving the toe guard panel from the first position into the second position;

an instigator member situated in a selected vertical position above the hoistway bottom surface and above the end of the toe guard panel to interact with the moving mechanism to begin movement of the toe guard panel from the first position when the frame member of the elevator car is approximately at the selected vertical position; and a bracket configured to position the instigator in the selected vertical position, the bracket being configured to be connected with a guide rail for establishing a desired horizontal position of the instigator member relative to a path of movement of the elevator car.

8. The assembly of claim 7, wherein the moving mechanism comprises a first roller and the instigator comprises a first cam at the selected vertical position, the first roller contacting the first cam as the frame member of the elevator car approaches the selected vertical position the first roller is near one end of the toe guard panel and the moving mechanism comprises a second roller closer to another end of the toe guard panel, the assembly comprising a second cam that interacts with the second roller to urge the toe guard panel toward the second position.

9. The system of claim 8, comprising a third roller and a third cam, the second cam having a surface that urges the second roller in a first direction as the elevator car frame member descends beneath the selected vertical position, the third cam having a surface that urges the third roller in a second direction that is generally opposite to the first direction.

10. The system of claim 8, wherein the toe guard panel comprises at least two panels that are foldable into the second position and wherein the second roller and the second cam urge one of the panels to move relative to another of the panels for moving into the second position.

11. The system of claim 7, comprising a locking member that maintains the toe guard panel in the first position and wherein the first cam causes movement of the first roller to unlock the locking member to allow the toe guard panel to begin to move from the first position toward the second position.

12. An elevator assembly, comprising:

a hoistway having a bottom surface;

an elevator car configured to move in the hoistway having a frame member;

at least one toe guard panel that is moveable between a first position and a second position, in the first position the toe guard panel is situated to provide a vertical surface beneath the elevator car and the toe guard panel has an end at a bottom of the toe guard panel, the end being spaced a first distance from the elevator car, in the second position the toe guard panel is situated with a second, shorter distance between the end and the elevator car;

a moving mechanism coupled with the toe guard panel for selectively moving the toe guard panel from the first position into the second position;

an instigator member situated in a selected vertical position above the hoistway bottom surface and above the end of the toe guard panel to interact with the moving mechanism to begin movement of the toe guard panel from the first position when the frame member of the elevator car is approximately at the selected vertical position;

wherein the moving mechanism comprises a first roller and the instigator comprises a first cam at the selected vertical position, the first roller contacting the first cam as the frame member of the elevator car approaches the selected vertical position;

wherein the first roller is near one end of the toe guard panel and the moving mechanism comprises a second roller closer to another end of the toe guard panel, the assembly comprising a second cam that interacts with the second roller to urge the toe guard panel toward the second position; and comprising a third roller and a third cam, the second cam having a surface that urges the second roller in a first direction as the elevator car frame member descends beneath the selected vertical position, the third cam having a surface that urges the third roller in a second direction that is generally opposite to the first direction.

13. The assembly of claim 12, wherein the first roller is near one end of the toe guard panel and the moving mechanism comprises a second roller closer to another end of the toe guard panel, the assembly comprising a second cam that interacts with the second roller to urge the toe guard panel toward the second position.

14. The system of claim 13, wherein the second cam is positioned vertically beneath the first cam and the second cam is near a lowest possible position of the elevator car frame member.

15. The system of claim 13, wherein the toe guard panel comprises at least two panels that are foldable into the second position and wherein the second roller and the second cam urge one of the panels to move relative to another of the panels for moving into the second position.

16. The system of claim 12, comprising a latch that maintains the toe guard panel in the first position and wherein the first cam causes movement of the first roller to unlock the latch to allow the toe guard panel to begin to move from the first position toward the second position.

17. An elevator assembly, comprising:

a hoistway having a bottom surface;

an elevator car configured to move in the hoistway having a frame member;

at least one toe guard panel that is moveable between a first position and a second position, in the first position the toe guard panel is situated to provide a vertical surface beneath the elevator car and the toe guard panel has an end at a bottom of the toe guard panel, the end being spaced a first distance from the elevator car, in the second position the toe guard panel is situated with a second, shorter distance between the end and the elevator car;

a moving mechanism coupled with the toe guard panel for selectively moving the toe guard panel from the first position into the second position;

an instigator member situated in a selected vertical position above the hoistway bottom surface and above the end of the toe guard panel to interact with the moving mechanism to begin movement of the toe guard panel from the first position when the frame member of the elevator car is approximately at the selected vertical position;

wherein the moving mechanism comprises a first roller and the instigator comprises a first cam at the selected vertical position, the first roller contacting the first cam as the frame member of the elevator car approaches the selected vertical position; and comprising a locking latch that maintains the toe guard panel in the first position and wherein the first cam causes movement of the first roller along the cam causing rotation of the locking latch to unlock the locking latch to allow the toe guard panel to begin to move from the first position toward the second position.

18. The assembly of claim 17, comprising a second cam and wherein the first roller is near one end of the toe guard panel;

the moving mechanism comprises a second roller closer to another end of the toe guard panel;

the second cam interacts with the second roller to urge the toe guard panel toward the second position;

the second cam is positioned vertically beneath the first cam; and the second cam is near a lowest possible position of the elevator car frame member.

19. The system of claim 18, comprising a third roller and a third cam, the second cam having a surface that urges the second roller in a first direction as the elevator car frame member descends beneath the selected vertical position, the third cam having a surface that urges the third roller in a second direction that is generally opposite to the first direction.

20. The system of claim 18, wherein the toe guard panel comprises at least two panels that are foldable into the second position and wherein the second roller and the second cam urge one of the panels to move relative to another of the panels for moving into the second position.

* * * * *